US008720174B2

(12) United States Patent
Kochmann

(10) Patent No.: US 8,720,174 B2
(45) Date of Patent: May 13, 2014

(54) YARN, ESPECIALLY A THREAD OR AN EMBROIDERY THREAD AS WELL AS A METHOD TO PRODUCE SUCH A YARN

(75) Inventor: Heiko Kochmann, Stadtbergen (DE)

(73) Assignee: Amann & Sohne GmbH & Co. KG, Bonnigheim (DE)

( * ) Notice: Subject to any disclaimer, the term of this patent is extended or adjusted under 35 U.S.C. 154(b) by 0 days.

(21) Appl. No.: 13/305,875

(22) Filed: Nov. 29, 2011

(65) Prior Publication Data

US 2012/0137649 A1 Jun. 7, 2012

(30) Foreign Application Priority Data

Nov. 29, 2010 (DE) ..... 10 2010 052 620
Oct. 20, 2011 (DE) ..... 10 2011 116 465
Oct. 26, 2011 (DE) ..... 10 2011 116 936

(51) Int. Cl.
*D02G 3/36* (2006.01)

(52) U.S. Cl.
USPC ..... 57/5; 57/224

(58) Field of Classification Search
USPC ..... 57/5, 12, 224, 227, 315, 350, 403
See application file for complete search history.

(56) References Cited

U.S. PATENT DOCUMENTS 3,342,028 A * 9/1967 Matsubayashi et al. ..... 57/12
3,343,356 A * 9/1967 McKinnon ..... 57/12
3,822,543 A * 7/1974 Edagawa et al. ..... 57/5
3,845,611 A * 11/1974 Senturk et al. ..... 57/5
4,056,924 A * 11/1977 Umiastowski ..... 57/5
4,296,597 A * 10/1981 Tani et al. ..... 57/205
4,489,540 A * 12/1984 Faure et al. ..... 57/5
4,492,075 A * 1/1985 Faure ..... 57/5
5,103,626 A * 4/1992 Morrison ..... 57/224
H1225 H * 9/1993 Foy et al. ..... 57/5
5,429,868 A * 7/1995 Truckenmuller et al. ..... 428/357
5,568,719 A * 10/1996 Proctor ..... 57/225
6,370,858 B1 * 4/2002 Mori ..... 57/6
2004/0025486 A1 * 2/2004 Takiue ..... 57/224

FOREIGN PATENT DOCUMENTS

DE 2232281 A1 1/1973
DE 3835169 A1 4/1990
DE 4035908 A1 5/1992
EP 0569891 A1 11/1993
JP 07216679 8/1995

OTHER PUBLICATIONS

Search Report published Jun. 13, 2013 corresponding to European Patent Application No. 11 00 9247.

* cited by examiner

*Primary Examiner* — Shaun R Hurley
(74) *Attorney, Agent, or Firm* — Ladas & Parry LLP

(57) ABSTRACT

A yarn, especially a sewing thread or an embroidery thread, is described, which has the structure of a core yarn with at least one core consisting of multifilament yarns and a spin over of staple fiber yarns. At least one portion of the fibers, which build the staple fiber yarn of the spin over, is bound between the filaments of the at least one multifilament yarn of the core over its total axial fiber length or over a section of its axial fiber length. Furthermore a method to produce this yarn is described.

19 Claims, 2 Drawing Sheets

Figure 1:
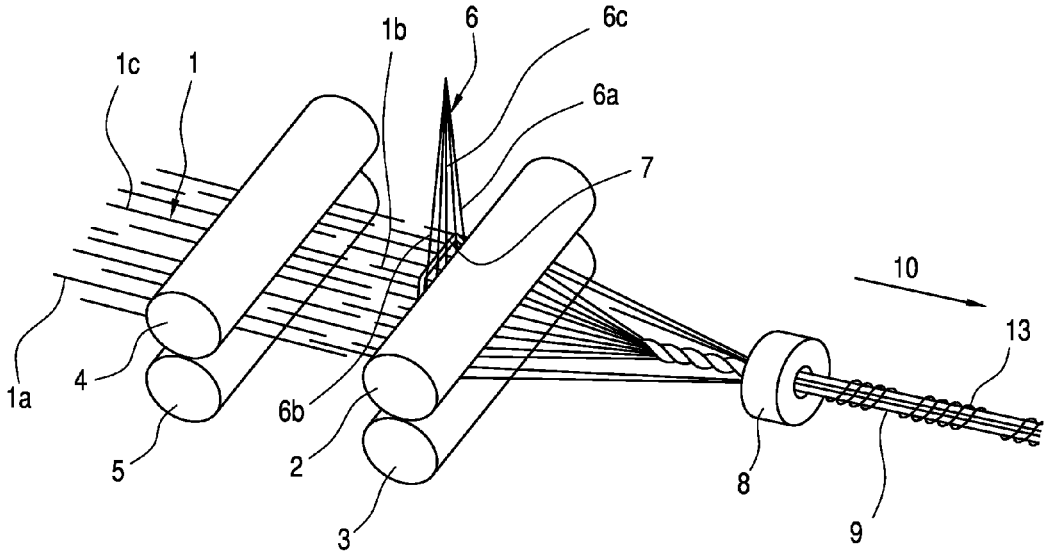

YARN, ESPECIALLY A THREAD OR AN EMBROIDERY THREAD AS WELL AS A METHOD TO PRODUCE SUCH A YARN

The present invention relates to a yarn, especially a sewing thread or an embroidery thread as described herein as well as a method to produce such a yarn as described herein.

Yarns, especially sewing threads or embroidery threads, having the structure of a core yarn, are known for a long time. So this known core yarns consist of a core, which is build of a multifilament yarn, whereby this multifile core is spin over with a staple fiber yarn, which is also usually referred to as staple fibers. This is done usually on a ring frame. To guaranty the necessary bond of the yarn, it is highly plied after the spin over of the core materials or alternatively to this at least two spin over core materials are twisted together after pre-twisting. By the afore mentioned high rotation or by the pre-twisting the staple fiber yarn spin over is fixed relatively to the then plied core material respectively the spin over and plied core materials due to the hereby caused outer clamping of the staple fiber yarn, so that a displacement of the spin over is avoided as far as possible.

Furthermore it is known that to produce relatively voluminous staple fiber yarns using staple fiber yarns by the so-called Murata-Vortex-air jet spinning method by means of only one air-jet spinning nozzle, whereby these yarns have a core of staple fiber yarns and a jacket of spin over fibers. This jacket of the so produced yarns has at least 75% by weight staple fibers relative to the cross section of the yarn, which are twisted around the core, which is formed by staple fiber yarns, by means of a fixed spindle, located downstream of a nozzle and the air turbulence, created thereby.

However the so produced yarns do not stand high mechanical needs like they impact on suitable sewing threads respectively embroidery threads while sewing and embroidering.

The production of the conventional core yarns described at the beginning is especially cost-intensive due to the applying of the rotation respectively the ply, whereas the last described pure staple fiber yarns are not suitable as sewing threads or embroidery threads.

The problem underlying the present intervention is to provide a yarn, especially a sewing thread or embroidery thread, that shows the construction of a core yarn, whereas the spin over of this core yarn, consisting of staple fiber yarns (=staple fiber yarns or for short fibers), should be fixed particularly tightly to the core material. Furthermore the problem underlying the present invention is to provide a particularly cost-effective method to produce the previously described yarn.

These problems are solved according to the present invention by a yarn with the characteristics as described herein as well as by a method with the characteristics as described herein.

The inventive yarn that is used especially as sewing thread or embroidery thread has the structure of a core yarn, whereby this core yarn is provided with a core, which consists of at least one multifilament yarn, which for its part have a spin over of staple fiber yarns. In contrast to the conventional core yarns described at the beginning, the inventive yarn has at least one part (portion) of the staple fibers, which build the especially untwisted or only little twisted staple fiber yarn of the spin over. This portion of the staple fiber is bound and especially clamped between the filaments of the at least one multifilament yarn of the core over its total axial fiber length or over a section of its axial fiber length. In other words, therefore a certain portion of the spin over-building fibers is bound and preferably clamped between the filaments, especially between the adjacent filaments, of the multifile core over their total axial fiber length or over a section of their axial fiber length, whereby the fibers of the spin over, which are not bound respectively not clamped are arranged spirally around the core material. In dependence on their length, the sections of fibers which are not bound respectively clamped wind themselves spirally around the core material and they fix the fibers which are not bound respectively not clamped or they stick out of the linear axis of the core.

Especially, the inventive yarn shows a portion of staple fibers, which amounts maximally 50% by weight, and preferably between 50% by weight and 25% by weight, and especially between 45% by weight and 35% by weight, relative to the weight of the ready-to-use core yarn.

The yarn according to this invention shows the advantage over the conventional core yarn that the spin over (wrapping) is secured in an especially safe and tight way in the view of a displacement relative to the linear axis of the core. Therefore the high rotation or twist described in the prior art at the beginning is not absolutely necessary. By that it is also explained that the yarn according to this invention shows a considerably smoother feeling (grip) than a conventionally produced yarn would show, which turns out to be an advantage according to the wearing comfort in case of ready-made products, especially in case of underwear, bed linen, towels, blouses, t-shirts or the like, which are provided with the sewing thread respectively embroidery thread according to this invention. The additional advantage of the yarn according to this invention is its production, which is especially inexpensive compared to conventional core yarns, as a cost-intensive high rotation or a twist is not absolutely necessary here.

The previously described positive features are found in particular in those embodiments of the inventive yarn, in which the part of the staple fibers, which are bound or clamped over the total axial length or only over a section of the axial filament length, varies between 1% by weight and 60% by weight, relative to the total staple fiber yarn weight of the spin over. In other words, 1% by weight to 60% by weight of the total staple fiber weight of the spin over are bound respectively clamped between the previously described filaments of the core material here, whereby the tendency of displacement of the spin over can be reduced further correspondingly with a rising portion of the so bounded respectively clamped fibers. This, in turn, allows by variation of the part of the bounded or clamped staple fibers an extremely easy adaption to the requirements concerning the respectively yarn. For example if it is worked with high speeds and the therefore used yarn is deflected many times while sewing or embroidering, it is appropriate to choose a high portion of staple fibers, which are bound and especially clamped over their axial length or over a section of their axial fiber length, like especially between 40% by weight and 60% by weight. However if the requirements on the particular inventive yarn are relatively low, especially while sewing and embroidering, which means, that it is processed with a relatively low speed and/or with a low number of deflections (redirections), the afore mentioned portion of fixed filaments varies preferably between 1% by weight and 15% by weight, and with corresponding higher requirements it varies especially between 16% by weight and 39% by weight, each referring to the total staple fiber yarn weight of the spin over.

Another possibility to adapt the inventive yarn to the special requirements is realized by the fact that in a further embodiment of the inventive yarn between 1% by weight and 30% by weight of the staple fibers of the spin over are bound only over a section and thus not over their total axial length between the filaments of the core, which consists of at least one multifilament yarn. In dependence on the level of the binding and especially of the clamping, that means especially in dependence on the space and so essentially on the length of the bounded section of the particular staple fibers, with this embodiment of the inventive yarn the special core yarn construction can be adapted on the requirements concerning the inventive yarn. Also in this embodiment a high part of the bounded fibers being fixed over a section of the axial fiber length, signifies an especially high stability of the yarn regarding the previously described mechanical stresses (high speed, high number of deflections), whereas a lower part of the these bounded fibers accordingly causes a lower stability of the yarn regarding the previously described mechanical stresses.

An especially advantageous embodiment of the inventive yarn provides that hereby the core yarn has a single multifilament yarn as core. In dependence on the number of filaments of this single multifilament core material and on the filament titre is consequently also the degree of fixing of the spin over consisting of staple fiber yarns by bounded or clamped staple fibers, so that such a yarn is preferably a fine yarn, meaning a yarn with a low titre.

However, such embodiments that has two to five multifilament yarns as core, has a significant higher mechanical stability. If those embodiments of the inventive yarn are additionally furnished with a little rotation after their production, so especially between 50 and 800 rotations/m, preferably between 250 and 500 rotations/m, the mechanical stability of these embodiments can be further improved respectively especially easy adapted to the particular requirements, which occur in processing of the yarn in the making-up (tailoring) by such easy and cost-effective methods, so that manifold tasks can be fulfilled by such a yarn.

As it is described before, especially the mechanical stability and preferably the displacement of the spin over depends also on the length of the staple fiber sections, which are bound from the capillaries (filaments) of the core. Preferably those bounded staple fiber sections are bound respectively clamped due to the filaments of the core-forming multifilament yarn with an axial length between 2% and 20%, referring to the staple length of the staple fibers of the staple fiber yarn, which build the spin over.

Another improvement of the mechanical stability of the inventive yarn can be obtained by the fact that at least one part of the staple fibers, which builds the staple fiber yarn of the spin over, is bound and especially clamped due to other staple fibers of the staple fiber yarn of the spin over. Such an additional binding of the staple fibers of the staple fiber yarn which builds the spin over, can be obtained by the fact, that the core yarn, produced accordingly to the invention, can be provided with a little rotation, which is also usually called protection rotation, whereas preferably therefore a rotation between 50 rotations/m and 500 rotations/m, especially between 100 rotations/m and 300 rotations/m is applied on the ready-to-use core yarn. It is also possible, that at least two inventive core yarns are plied together with or without a protection rotation, whereas therefore low ply twists between 50 rotations/m and 800 rotations/m, preferably between 250 rotations/m and 500 rotations/m are especially preferred. If the inventive yarn contains core yarns having a protection rotation, the afore mentioned low rotations for the ply twists are provided in dependence on the rotation of the protection rotation, whereas the protection rotation is applied preferably in S-direction and the ply twist is applied preferably in Z-direction.

Also the previously described binding of the staple fibers of the spin over can be achieved by the fact, that a special bonding is applied on the inventive yarn, preferably in a concentration between 0.2% by weight and 5% by weight referring to the weight of the ready-to-use yarn.

With regard to the single filament number of the at least one multifilament yarn, which builds the core, it should generally be noted that the desirable fixation of the spin over-building staple fiber yarns depends on the dimension of the single filament number. High single filament numbers of the multifile core accordingly cause a higher fixation of the bounded staple fibers of the staple fiber yarn spin over and thereby a higher mechanical stability, too, especially against an unwanted displacement of the spin over while processing of the yarn, which can finally lead to a break of the yarn when further processed or to defective production, whereby the single filament number of the multifile core varies between 12 and 1000, preferably between 24 and 96.

Especially suitable embodiments of the inventive yarn have such multifilament yarns as core, whose titre of each single (individual) filament varies between 0.7 dtex and 5 dtex, preferably between 2.5 dtex and 3.8 dtex. Also through this the possibility to adapt the level of fixation of the staple fibers of the spin over-building staple fiber yarn by variation of the titre of each single filament exists.

With regard to the material, of which the core-building multifilament yarn consists, it should be generally noted that therefore synthetic and semisynthetic multifile yarns are chosen. This includes especially polyalkylene, preferably ultra high modular polyethylene (Dyneema), Peek, glass fibers, carbon fibers, viscose, modal fibers and/or polyacrylic fibers. However, for using the inventive yarn as sewing thread or embroidery thread, it is especially suitable if these embodiments contain multifile viscose fibers, multifile polyester fibers, especially high-strength polyester fibers, multifile polyamide 6.-fibers, multifile polyamide 6.6.-fibers, multifile aramid fibers and/or multifile polyamide fibers as materials.

The term "and/or" used in this description means, that all or some elements of the enumeration regarding this should be understand additively or that some or all elements of the enumeration regarding this should be understand alternatively, whereas the term polyester includes especially such materials, whose consist of polyethylenterephtalate. Furthermore it should be noted that all terms of the present description of the invention which are used in the singular also includes the plural of those terms.

Further the term card sliver describes all tape like objects, in which the staple fibers exist as far as possible or completely in a parallel arrangement, and thus includes the terms drafted sliver, card sliver or combed sliver (band), used in technology. A combed sliver (band) is usually such a band of parallelized staple fibers, which shows a lower portion of impurities and/or staple fibers with a smaller axial length compared to an uncombed sliver (band).

Staple fiber yarn, which is used as the spin over of the inventive yarn, includes preferably synthetic and/or natural staple fiber yarns. It is especially suitable if the inventive yarn contains an especially untwisted or just a little twisted staple fiber yarn (assemblage of staple fibres) made of cotton, polyester, polyamide, panox, polyacrylnitril, viscose, modal, wool, polypropylene, acetate and/or aramid as the spin over. The single (individual) fiber titre of the afore mentioned staple yarns varies especially between 0.6 dtex and 2 dtex, preferably between 0.8 dtex and 1.5 dtex.

Concerning to the length of the staple of the afore mentioned staple fiber yarns it generally should be noted, that this concerns to the level of the spin over. Especially for the spin over, the inventive yarn contains such staple fiber yarns, whose length of the staple varies between 25 mm and 60 mm, preferably between 30 mm and 50 mm.

By variation of the core material, that means in dependence on whether the core material is a multifile flat yarn, a multifile textured yarn or a multifile air-jet texturized yarn, preferably a yarn, intermingled by air, the volume and the characteristics of the inventive yarn can be varied further in the desired matter. If a multifile flat yarn is used as the core material, the inventive yarn shows a relatively low volume and a lower reversible elasticity compared to an embodiment which uses a multifile air-jet texturized yarn or a textured yarn, while the quantitative portion of spin overs remains constant. By replacing this flat yarn with a textured multifile core material the elasticity of the inventive yarn increases, whereas a high volume and a relatively high reversible elasticity is made available by using a multifile air-jet texturized core material.

Depending on the particular use of the inventive yarn, it shows especially between 40% by weight and 80% by weight, preferably between 50% by weight and 75% by weight of the core-building multifilament yarn and between 60% by weight and 20% by weight, preferably between 50% by weight and 25% by weight of the spin over.

Especially stabile embodiments of the inventive yarn are obtained by the fact, that two to ten, preferably two to four core yarns, like they are previously described in connection with the inventive yarn, are plied together. These embodiments of the inventive yarn show excellent properties during sewing at high strengths, what is especially advantageous at high sewing velocities, which reach up to 6000 m/min.

The present invention concerns also a method to produce the several previously described embodiments of the inventive yarn with the features as described herein.

The inventive method to produce the inventive yarn provides that at least one card sliver, which builds the spin over of the yarn, is drawn over at least by one draw frame passage and that the drawn card sliver is added to an air-jet spinning nozzle together with the at least one multifilament yarn, that builds the core of the yarn.

The inventive method shows analogous or identically all the advantages, as they are described previously for the corresponding inventive yarn.

It is especially advantageous regarding the binding of the staple fibers of the staple fiber yarn, which builds the spin over, if the at least one multifilament yarn in the inventive method is spreaded (spread apart) before the contact with the air-jet spinning nozzle. This spreading apart effects that the staple fibers of the staple fiber yarn are spun and fixated during the actual spinning process, like it is comprehensively described previously in the inventive yarn. In this occasion the spreading apart causes that an sufficient great distance is build between the single capillaries of the core, so that correspondingly the binding respectively clamping of the staple fibers of the staple fiber yarn, which build the spin over, can happen excellently.

The previously described spreading apart of the filaments of the multifile core can be induced pneumatically, that means thus especially by a stream of gas and preferably by a stream of air, which impacts on the multifilament yarn by means of a suitable nozzle or by suction.

It is also possible to induce the desirable spreading apart mechanically, whereby in this case either an actually known wheel, which makes contact with the multifilament yarn and runs across its direction of transport, or a band is provided. Depending on the speeds of the band respectively the wheel and the supplied multifilament yarn, as well as the friction, which occurs between the wheel or the band, the level of the spreading apart can be controlled respectively regulated. However it is especially suitable if the multifilament yarn spreaded by contact with a finger like temple, whereby the level of the spreading apart is variable especially by the shape and preferably by the curvature of the finger like temple, the type of delivery of the multifilament yarn, especially its delivery tension and its delivery angle.

If in connection with the inventive yarn or in connection with the inventive method, it is turned out that the yarn, which builds the core, is a multifilament yarn, of course this multifilament yarn can be replaced by a group of monofilament yarns or by air-jet texturized yarns. On this occasion this group of the afore mentioned yarns is upstream supplied the air-jet spinning nozzle in such a way, that the monofilaments respectively the single air-jet texturized yarns are arranged with a distance from each other.

If not only one single multifilament yarns, but several and especially two to five multifilament yarns are used for core, these multifilament yarns are fed preferably separately into the at least one drawn card sliver upstream the air-jet spinning nozzle in such a way, that they are arranged with distance from each other from the beginning. Thus in this variation of the inventive method, it is possible to waive the spreading apart, whereby it is naturally possible to provide the previously described variations of spreading apart here, too.

However, it is naturally possible to feed the afore mentioned two to five multifilament yarns, which build the core of the core yarn, to the drawn card sliver altogether or in groups and thereby bunched.

The terms feed or deliver, as used previously in connection with the inventive method, means especially that the multifilament yarn respectively the multifilament yarns are brought into contact with the at least one drawn card sliver. This can preferably achieved by a tube or a ring through which the multifilament yarn is transported, that is especially positioned directly in front of the air-jet spinning nozzle, relative to the direction of transport of the card sliver.

If in the inventive method it is worked with a staple fiber yarn, which builds the spin over of the inventive yarn, made of natural fibers and especially of cotton fibers, a further embodiment of the inventive methods provides that the card sliver is additionally combed. The combed band which is created from the card sliver then shows an even length of the staple fibers, because such staple fibers which have a quite short staple length, are combed out by this additional production step. This, in turn, leads to the fact, that the yarn, which is produced out of this, especially a sewing thread or an embroidery thread, can be processed faultlessly within the tailoring even under extreme mechanical stress.

It is especially advantageous, if the card sliver in the inventive method is drawn over a drawing (stretching) zone with at least two and preferably with two to three draw frame passages, as hereby a faultlessly drawing on the one hand and a high production speed one the other hand are enabled.

Especially good results in regard to the mechanical-technological characteristics of the inventive yarn are achieved by drawing the card sliver before the spinning of the yarn, especially on the spinning machine, using a total drawing ratio (draft) between 50-fold and 350-fold, preferably between 230-fold and 280-fold.

Particularly the drawing of the card sliver in the inventive method is performed in such a way that the card sliver is submitted with a sliver fineness between 5 Ktex and 1.5 Ktex to the drawing zone (passage).

Due to the fact, that the inventive method enables high production speeds, the inventive core yarns can be produced especially cost-effective under this method. High speeds mean preferably that the drawn card sliver is fed to the air-jet spinning nozzle with a delivery speed between 150 m/min and 400 m/min, preferably between 220 m/min and 320 m/min.

If an especially high fixation of the spin over-building staple fiber yarns relatively to the core material should be achieved, it is advantageously appropriate to twist the inventive yarn or to ply it with at least another inventive yarn after its production. Thereby the twist respectively the plying varies preferably between 50 rotations/m and 800 rotations/m, especially between 250 rotations/m and 500 rotations/m.

Advantageous further embodiments of the inventive yarn as well as the inventive method are described herein.

Figure 2:
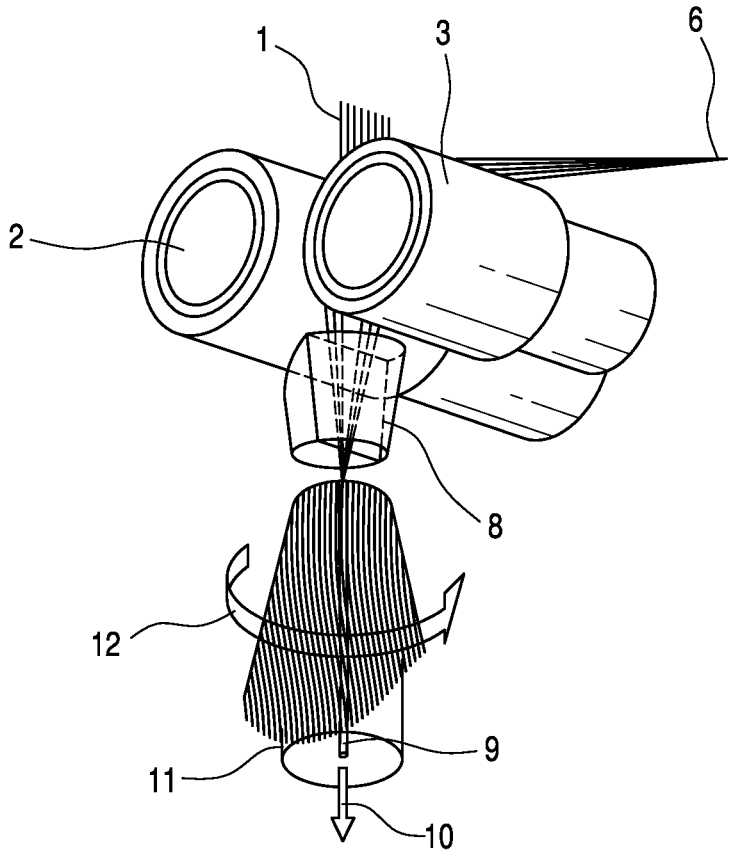

The invention is subsequently explained in details by the examples in conjunction with the drawing, whereby the drawing schematically shows in:

FIG. 1 a top view of the section of the feeding of the core-building multifilament yarn to the staple fiber yarn which builds the spin over; and FIG. 2 a side view of FIG. 1, partial with opened air-jet spinning nozzle In the figures, the same elements are provided with the same reference numbers. It is emphasized, that the figures are schematically, but no scaled drawings.

It should be marked, that for clarification in FIG. 1 the spindle is not shown, whereby this spindle is shown in detail in FIG. 2 and arranged in the transport way of the yarn, as marked with arrow 10.

A drawn card sliver overall designated with 1 shows a multitude of parallelized single staple fibers 1*a* to 1*c*, whereby in this FIG. 1, only three single staple fibers are illustrated as examples. The pair of rollers 2 and 3 build the delivery end pair of rollers of the drawing zone, whereby another pair of rollers 4 and 5 is arranged reverse to the running direction 10 of the yarn upstream of the pair of rollers 2 and 3.

With 6, a multifilament yarn is designated, which builds the core of the ready-to-use yarn. This multifilament yarn 6 shows a multitude of single filaments 6*a*, 6*b* and 6*c*, whereby only the outer both single filaments 6*a* and 6*b* as well as an exemplary middle single filament 6*c* is illustrated. From a not shown stock the multifilament yarn 6 is removed and spreaded in delivery direction over a finger like temple 7, so that the exemplary shown single filaments 6*a*, 6*b* and 6*c* are arranged with distance from each other and fed to the exemplary shown staple fibers 1*a*, 1*b* and 1*c* of the drawn card sliver. This leads to the fact, that a portion of the staple fibers of the card sliver 1 are then at least partially bounded and especially clamped and fixated by single filaments, especially by adjacent filaments of the multifilament yarn 6, when the yarn has passed the air-jet spinning nozzle 8 and the belonging spindle 11. By the pair of rollers 2 and 3 the drawn card sliver, which is brought in contact with the multifilament yarn 6, is fed into the air-jet spinning nozzle 8, whereby the inventive yarn 9 is spun by the air-jet spinning nozzle 8 with the belonging spindle 11.

FIG. 2 illustrates this spinning process in detail. Downstream of the air-jet spinning nozzle 8 a fixed spindle 11 is arranged which, as already mentioned, is not illustrated in FIG. 1. Due to the air flow relations and the special geometry of the nozzle, existing in the air-jet spinning nozzle, a portion of the staple fibers of the card sliver 1 is put over the spindle 11 downstream of the air-jet spinning nozzle and shifted into a rotation according to the arrow 12, which leads to the fact that this portion of the staple fibers of the staple fiber yarn wraps itself around the core and builds the spin over there, like it is marked schematically in FIG. 1 with the reference sign 13.

EXAMPLE 1

On a Murata-Vortex air spinning machine "Type 861 E-Luftspinnmaschine" (manufacturer: Murata Machinery Ltd., Japan) a card sliver, consisting of a polyester staple fiber yarn, type 333, staple fiber length 38 mm, titre of each fiber 1.3 dtex, was air spined after the drawing of the card sliver in such a way as it is previously illustrated in principle in the FIGS. 1 and 2 and described. It should be noted that the machine was additionally equipped with the illustrated and described finger like temple 7.

Every of the both used multifilament yarns consists of polyester, type 712, 33 dtex, f 16. Therefore the following parameters were adjusted on the Vortex-machine:

main drawing ratio: 55-fold
total drawing ratio: 270-fold
delivery- and taking up proportion: 0.980
delivery speed: 270 m/min
crosswinding: 16° traversing angle
air nozzle pressure: 5 bar Two core yarns, produced in this way, were plied afterwards on a Hamel 2000-machine, whereby the direction of rotation during plying was S and the twist was 450° rotations/m.

EXAMPLE 2

A second yarn was produced by the previously described machine. Therefore, the following parameters were taken as a basis:

The used multifilament yarn, which builds the core, consists of polyester, type 714, 74 dtex, f24. Therefore the following parameters were adjusted on the Vortex-machine:

main drawing ratio: 55-fold
total drawing ratio: 270-fold
delivery- and taking up proportion: 0.980
delivery speed: 263 m/min
crosswinding: 16° traversing angle
air nozzle pressure: 5 bar Cotton was chosen as the staple fiber yarn, which builds the spin over of the core yarn, with a fiber titre of 3.8 dtex and a staple length of 34 mm.

Two of the so produced core yarns then were plied on a Hamel 2000-machine, whereby the direction of rotation during plying was S and the twist was 450° rotations/m.

EXAMPLE 3

A third yarn was produced on the previously described machine. Therefore the following parameters were taken as a basis: Every of the both used multifilament yarns, which build the core, consists of polyester, type 712, 74 dtex, f24. Therefore the following parameters were adjusted on the Vortex-machine:

main drawing ratio: 40-fold
total drawing ratio: 235-fold
delivery- and taking up proportion: 0.96
delivery speed: 240 m/min
crosswinding: 16° traversing angle
air nozzle pressure: 6.5 bar Polyester, type 333 with a titre of the single staple fiber of 1.3 dtex and a staple length of 38 mm, was chosen as the staple fiber yarn, which builds the spin over of the core yarn.

Three of the so produced core yarns then were twisted on a Lezzeni TBR-LA-machine, whereby each core yarn was provided firstly with a rotation of 520 rotations/m in S-direction.

Afterwards, these three pre-twisted core yarns were plied, whereby a ply rotation with 500 rotations/m was applied in Z-direction.

The following technical parameters were determined from the previously produced plied core yarns, which are used as sewing thread.

| Technical parameters | Yarn according to example 1 | Yarn according to example 2 | Yarn according to example 3 |
|---|---|---|---|
| total linear density in dtex | 310 (155 × 2) | 322 (161 × 2) | 897 (299 × 3) |
| maximum tensile strength in cN | 1212 ± 37 | 1196 ± 106 | 3893 ± 70.5 |
| maximum elongation at break in % | 15.76 | 14.99 | 20.5 |
| tenacity in cN/tex | 38.96 | 37.04 | 43.36 |

The sewing behavior of the afore mentioned three plied core yarns according to the examples 1 to 3, which were developed as sewing threads, was determined. The results are summarized in the following table.

| Sewing operation | Yarn according to example 1 | Yarn according to example 2 | Yarn according to example 3 |
|---|---|---|---|
| reverse sewing 150 cN (%) | 95.4 | 100 | |
| reverse sewing 200 cN (%) | 83.4 | 97.6 | |
| thermal load capacity | | | 208 mm |
| forward sewing number of yarn breaks | | | 0 |
| zigzag sewing 275 cN | | | |
| yarn break | | | 0 |
| fault stitch | | | 0 |
| zigzag sewing 325 cN | | | |
| yarn break | | | 0 |
| fault stitch | | | 0 |

In order to determine the sewing behavior of the yarns according to the example 1 and 2, a modified industrial sewing machine, type Pfaff DOST sewing machine, class 483-G-8/01-900/5 was used, whereby a stitch length of 5 stitches/cm, a stitching frequency of 5000 stitches/min and a needle system, system 134, needle size Nm 80 was taken as a basis. Two layers of an object (manufacturer; Ettlin Spinnerei, Germany, KF72 260 cm variaminblau, 3344 Sanfor, cotton, 100% OE-yarn) were cut to 150 cm in chain direction and sewed together on one side. The strip width amounted ca. 20 cm in weft direction. Per unit and tension region, 5 seams are made, whereby it is sewed till a length of 750 cm or till the yarn breaks.

For evaluation the proportion of the average sewing length of all five seams is determined and results in the reverse sewing properties of each analyzed yarn, which is expressed as a portion. To exclude faults, the particular result is set in correlation to the values, which are determined with a standard filament.

In order to determine the sewing properties (thermal load capacity) of the yarn according to the example 3, a modified industrial sewing machine, type Pfaff DOST sewing machine, class 483-G-8/01-900/5 was used, whereby a customary underthread Nm 50, a stitch length of five stitches/cm, a stitching frequency of 5000 stitches/min and a needle system 134, needle size Nm 90, were taken as a basis. Seven layer of a textile were cut to ca. 30 cm in chain direction and to ca. 25 cm in weft direction, lapped and sewed together five times over the total length with a stitch distance of ca. 3 mm. The mean length of the seam in mm to the break of the yarn results in the thermal lead capacity. At the yarn break, the yarn was melted on. To exclude faults, the particular result is set in correlation to the values, which are determined with a standard filament.

To determine the forward sewing properties of the yarn according to the example 3, a modified industrial sewing machine, type Dürkopp Adler DOST sewing machine, class 272-140342, was used, whereby a stitch length of 3 stitches/cm, a stitching frequency of 5000 stitches/min and a needle system of the needle size Nm 80 were taken as a basis. Three layers of a fleece were cut to 150 cm, the triple fleece layers were placed around the table of the sewing machine and fixed in a way that the cutting edges overlap. The so produced endless band were sewed with full speed in thirty tours each having 45 m.

For evaluation the number of yarn breaks was determined. To exclude faults, the particular result is set in correlation to the values, which are determined with a standard filament.

To determine the zigzag sewing behavior of the yarn according to the example 3, a industrial sewing machine, type Pfaff sewing machine, class 428 was used, whereby a stitch length of 1.5 stitches/cm, a stitching frequency of 3500 stitches/min, an over stitch width of 5.0 mm and a needle system 438, needle size Nm 110, were taken as a basis. Both, the needle thread and the under thread, consist of the yarn according to the example 3. Three layer of a standard fleece were cut to 150 cm. The doubled fleece layers were placed around the table of the sewing machine by building an endless band, the cutting edges overlapped and were fixed.

For each described tension region 15 m seam were sewed with high speed. In the table above, the number of yarn breaks and the number of fault stitches per tension region are shown. To exclude faults, the particular result is set in correlation to the values, which are determined with a standard filament.

The standard fleece, used while the forward sewing and the zigzag sewing in the sewing trial which is previously described in the example 3, is a fleece of the company Freudenberg (product designation BO 50810T150L100, article number 53385724). To determine the thermal load capacity, the used web was manufactured by the Spinnweberei Uhingen, Germany, and shows the following technical characteristics: tarpaulin fabric, 159 cm R 2/2, 28/32.5 28/16 cm/Nm, chain cotton, 100% OE-yarn, weft cotton, 100% ring spin yarn.

The previously described examples demonstrate, that all three twists have good to excellent sewing characteristics.

What is claimed is:

1. A method for producing a sewing yarn or an embroidery yarn, having the structure of a core yarn, comprising a multifile core and a spin over with staple fibers, using an air-jet spinning machine, a) wherein a multitude of staple fibers were parallelized to produce at least one card sliver, b) wherein the at least one card sliver is drawn over at least one draw frame passage, c) wherein the at least one drawn card sliver is delivered together with two to five core-forming multifilament yarns to an air-jet spinning nozzle in such a manner that one part of the staple fibers of the at least one card sliver is bound and clamped between the filaments of the two to five multifilament yarns of the core, relative to the total axial staple fiber lengths or relative to a section of the axial staple fiber lengths, d) wherein said part of the bound and clamped staple fibers varies between 1% by weight and 60% by weight, relative to the total weight of staple fibers of the spin over, and e) wherein the portion of staple fibers of the spin over is varied between 50% by weight and 25% by weight and the portion of the core-forming multifilament yarns is varied between 50% by weight and 75% by weight, relative to the weight of the core-yarn.

2. The method according to claim 1, wherein between 1% by weight and 30% by weight of the fibers of the spin over are bound and clamped over a section of their axial fiber length between the filaments of the core comprising the two to five multifilament yarns.

3. The method according to claim 1, wherein part of the staple fibers is bound and clamped with a bound and clamped length between 2% and 20%, relative to the length of the staple fibers of the spin over through the multifilament yarns forming the core.

4. The method according to claim 1, wherein at least one portion of the staple fibers of the spin over is bound and clamped by other staple fibers of the spin over.

5. The method according to claim 1, wherein the two to five multifilament yarns are spread before the contact with the air-jet spinning nozzle.

6. The method according to claim 1, wherein the two to five multifilament yarns which form the core of the core yarn are delivered separately to the drawn card sliver.

7. The method according to claim 1, wherein the card sliver is combed.

8. The method according to claim 1, wherein the card sliver is drawn over a drawing zone with two or three drawing passages.

9. The method according to claim 1, wherein the card sliver is drawn with a total drawing ratio between fiftyfold and three hundred and fiftyfold, before the core yarn is spun.

10. The method according to claim 1, wherein the card sliver is submitted with a sliver fineness between 5 Ktex and 1.5 Ktex to the drawing zone.

11. The method according to claim 1, wherein the drawn sliver card is delivered to the air-jet spinning nozzle with a delivery speed between 150 m/min and 400 m/min.

12. The method according to claim 1, wherein the core yarn is provided with a protection twist between 50 twists/m and 800 twists/m.

13. The method according to claim 12, wherein the core yarn is provided with a protection twist between 100 twists/m and 300 twists/m.

14. A sewing yarn or embroidery yarn, produced by the method according to claim 1, wherein the core forming multifilament yarns have a number of filaments between 12 and 1000.

15. A sewing yarn or embroidery yarn, produced by the method according to claim 1, wherein the core forming multifilament yarn contains filaments each with a titre between 0.7 dtex and 5 dtex.

16. A sewing yarn or embroidery yarn, produced by the method according to claim 1, wherein the core forming multifilament yarns consist of multifile viscose filaments, multifile polyester filaments, multifile polyamide 6. filaments, multifile polyamide 6.6. filaments, multifile aramid filaments and/or multifile polyamide filaments.

17. A sewing yarn or embroidery yarn, produced by the method according to claim 1, wherein the staple fibers of the spin over are synthetic staple fibers and/or a natural staple fibers, and have a single fiber titer between 0.6 dtex and 2 dtex.

18. A sewing yarn or embroidery yarn, produced by the method according to claim 1, wherein the staple fibers of the spin over have a staple length between 25 mm and 60 mm.

19. A sewing yarn or embroidery yarn, produced by the method according to claim 1, wherein the core forming multifilament yarns are multifile flat-yarns, multifile textured yarns, or multifile air-jet texturized yarns.

* * * * *